United States Patent [19]

Ward

[11] 4,407,204

[45] Oct. 4, 1983

[54] DOOR-LOCKING MECHANISMS FOR SECURITY ENCLOSURES

[75] Inventor: Geoffrey M. Ward, Wombourne, England

[73] Assignee: Chubb & Son's Lock and Safe Company Limited, London, England

[21] Appl. No.: 324,745

[22] Filed: Nov. 25, 1981

[51] Int. Cl.[3] ..... E05G 1/04; E05B 63/00; E05C 1/04

[52] U.S. Cl. ..... 109/59 R; 70/1.5; 292/153

[58] Field of Search ..... 109/52, 51, 58, 59 R, 109/60, 61, 62, 63, 63.5; 70/1.5, 115, 118, 119; 292/40, 153

[56] References Cited

U.S. PATENT DOCUMENTS

| | | | |
|---|---|---|---|
| 3,937,503 | 2/1976 | Harris | 292/153 |
| 4,266,488 | 5/1981 | Markham | 70/1.5 |

FOREIGN PATENT DOCUMENTS

| | | | |
|---|---|---|---|
| 339166 | 7/1921 | Fed. Rep. of Germany | 109/59 |
| 559696 | 9/1932 | Fed. Rep. of Germany | 292/153 |
| 1012115 | 12/1965 | United Kingdom | 109/59 |

*Primary Examiner*—Gene Mancene
*Assistant Examiner*—James R. Hakomaki
*Attorney, Agent, or Firm*—Pollock, Vande Sande & Priddy

[57] ABSTRACT

A locking mechanism for a vault door having a plurality of independently negatable locks, each one coupled through its bolt to a respective pivoted locking arm. In the locking condition the arms are pivoted to block withdrawal of bars carried by the main boltstraps. Each lock bolt is connected to its arm by a rotatable control member having a lobe and an eccentric peg which engages in a slot in the respective arm. To negate a lock its bolt is thrown and a lever turned to rotate the respective control member. This places the lobe next to the lock case and pivots the locking arm into its unblocking position. If the door is left open with the boltwork withdrawn and unlocked unauthorized negation of a lock cannot take place because there is insufficient space to rotate the respective control member without the latter abutting the lock case. If the door is left open with the boltwork thrown and locked unauthorized negation might occur if access is gained to the mechanism, but this will be immediately apparent when the bank staff come to close the door at the end of the day as this procedure first involves withdrawing the lock bolts and the bolt of the negated lock will be blocked by the proximity of the control member lobe to the lock-case.

12 Claims, 7 Drawing Figures

DOOR-LOCKING MECHANISMS FOR SECURITY ENCLOSURES

The present invention relates to door-locking mechanisms for vaults, strongrooms, safes and the like security enclosures.

The doors of such enclosures are generally equipped with a series of bolts which can be driven by an external handle or wheel to engage with the surrounding door frame, and one or more locks which are operable to resist withdrawal of the boltwork when thrown. The use of multiple locks is common. It is also a common practice in banks, for example, for the keys or combinations of the different locks on a vault door or the like to be issued to different individual staff members, thus requiring the attendance of each such member whenever the respective door is to be locked or unlocked. This practice has obvious advantages from the point of view of security but cannot be adhered to strictly when relevant personnel have to be absent. The present invention accordingly seeks to provide a multi-lock locking mechanism for the door of a security enclosure which, in the context of the foregoing, can accommodate anticipated staff absence by permitting the selective negation of one or more of the locks. By "negation" of a lock in this specification is meant placing the mechanism into a condition in which the selected lock is no longer operable to resist withdrawal of the main boltwork. It is a requirement of such mechanism that under any normal conditions of use negation of a lock cannot take place without the active cooperation of a holder of the correct key or combination for that lock, or if such negation is effected then the negated condition of the lock can be readily detected, from the outside of the enclosure.

In one aspect the invention resides in a locking mechanism for the door of a security enclosure comprising a main boltwork and a plurality of independently-operable locks for resisting withdrawal of the boltwork when in its thrown condition, wherein at least one of said locks can be selectively negated; the or each such negatable lock having a bolt coupled to a movable locking member such that throwing the lock bolt moves the respective locking member into a locking position to resist withdrawal of the main boltwork; and further comprising control means in respect of the or each such negatable lock which are selectively operable, only while the respective lock bolt is thrown, to withdraw the respective locking member from its said locking position and to resist subsequent withdrawal of the respective lock bolt.

In a preferred embodiment, the bolt of each such negatable lock is coupled to its respective locking member through a respective control member; the control member being mounted rotatably to the lock bolt and comprising a peg offset from the axis of rotation and engaging in a drive slot in the locking member, and an abutment portion; the control member having a non-negating position in which throwing the lock bolt moves the locking member as aforesaid by virtue of the coupling between said peg and drive slot, and a negating position into which the control member can be rotated, only while the lock bolt is thrown, to withdraw the locking member from its locking position by virtue of the movement of said peg incident upon said rotation, and to place said abutment portion in a position to abut a fixed obstruction thereby to resist subsequent withdrawal of the lock bolt.

The invention will now be more particularly described, by way of example, with reference to the accompanying drawings, in which.

Figure 1:
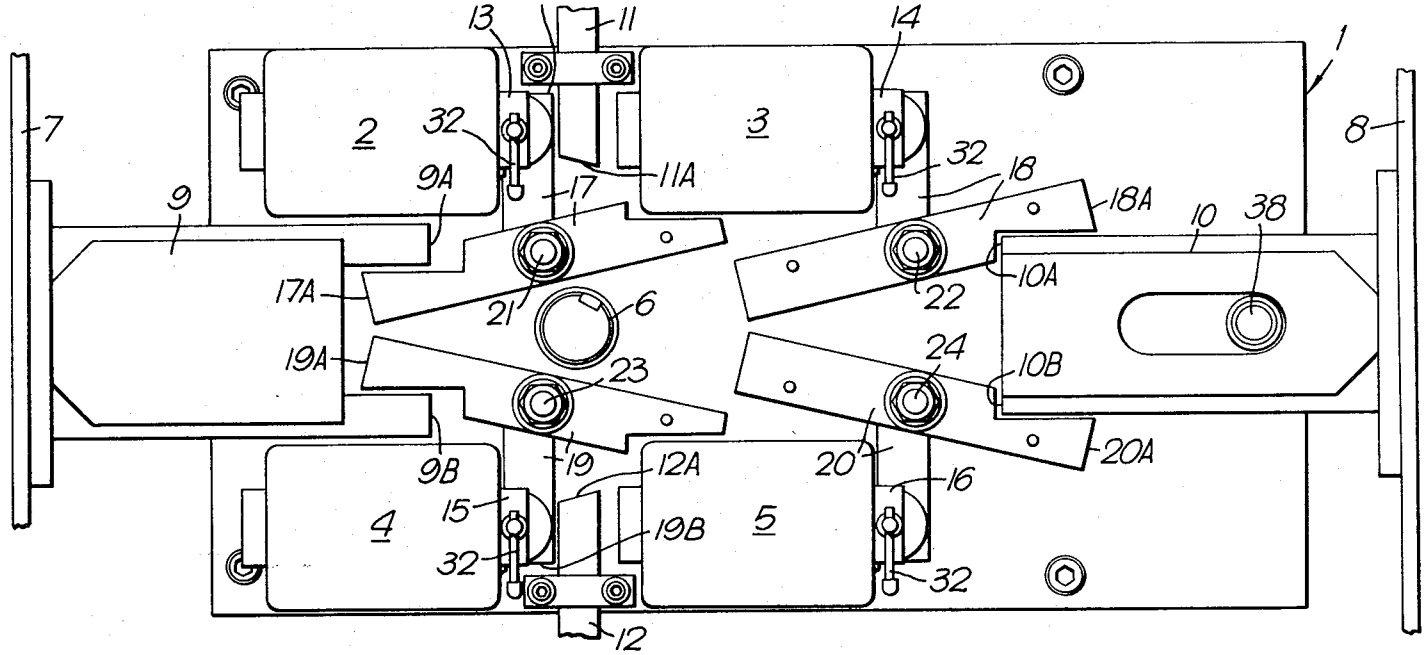
FIG. 1 shows a preferred embodiment of a vault door locking mechanism in accordance with the invention, as viewed from the internal face of the door and with an associated access panel removed, the mechanism being in the condition in which the main boltwork is withdrawn and each lock is withdrawn.
Figure 2:
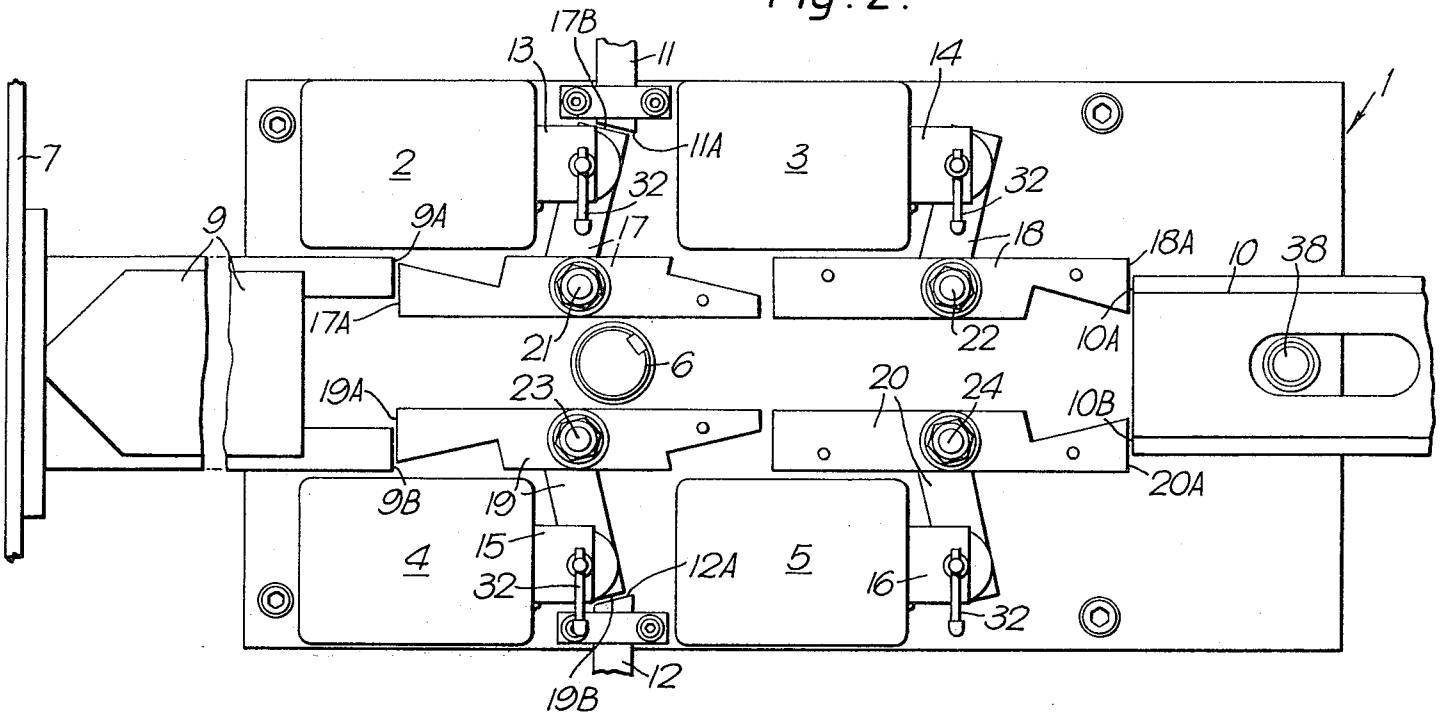
FIG. 2 is a view of the mechanism from the same aspect as FIG. 1, but in which the main boltwork is thrown and the locks thrown.
Figure 3:
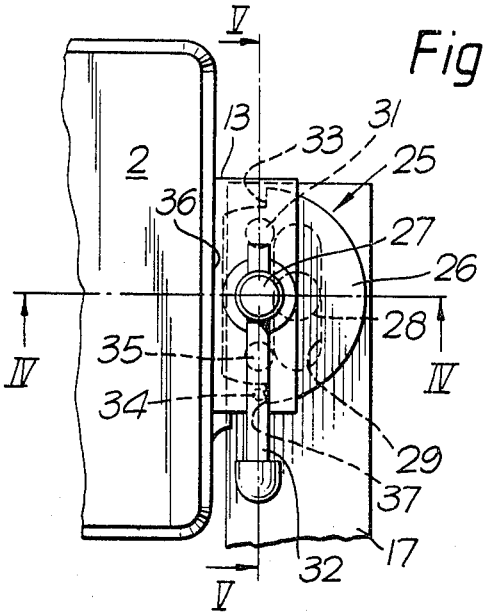
FIG. 3 shows, to an enlarged scale, the coupling of a lock bolt to the corresponding locking member in the mechanism of FIGS. 1 and 2.
Figure 4:
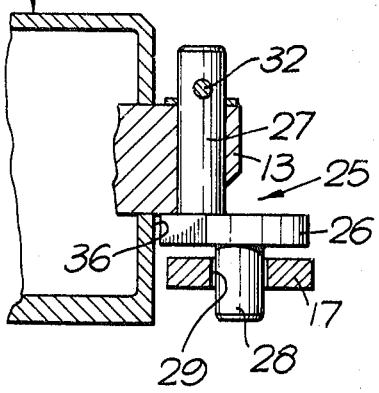
FIG. 4 is a section on the line IV—IV of FIG. 3.
Figure 5:
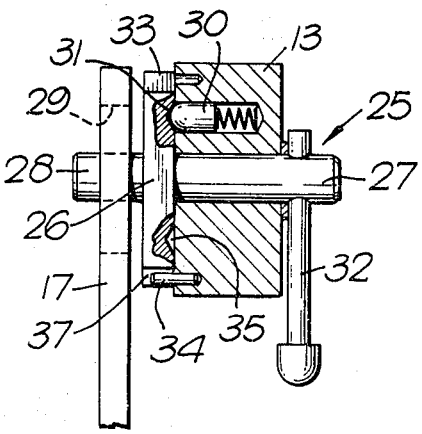
FIG. 5 is a section on the line V—V of FIG. 3.
Figure 6:
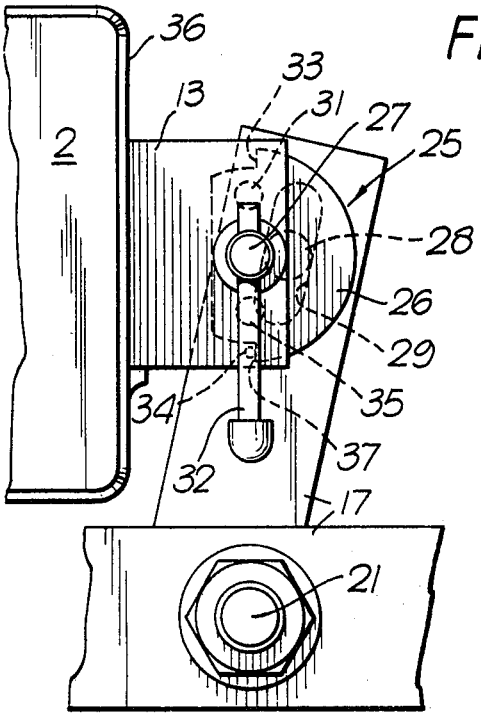
FIGS. 6 and 7 show the coupling of FIG. 3 in different operative conditions of the mechanism.
Figure 7:
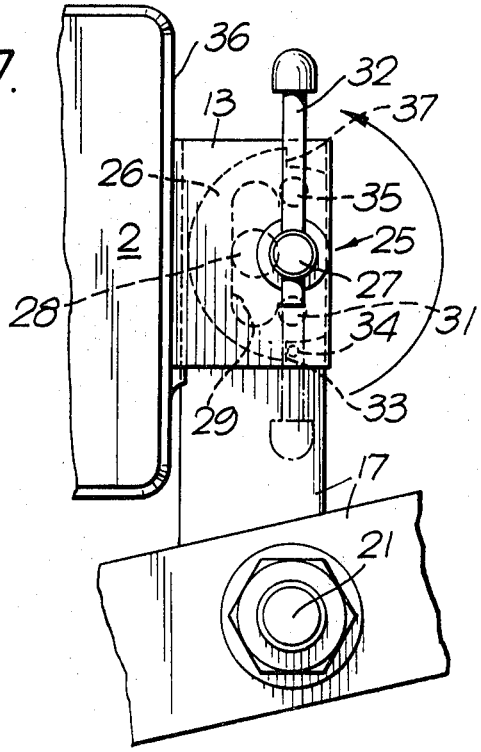

Referring to FIGS. 1 and 2, the illustrated locking mechanism has a mounting plate 1 to which four independently-operable key or combination deadlocks 2–5 are fixed. The mechanism as illustrated is for a door with a four-way boltwork, that is to say bolts are thrown from all four edges of the door into the surrounding frame. The throwing mechanism for this boltwork is located on the remote side of the plate 1 as viewed in these Figures, and may be of the known type comprising a central disc (of which the spindle is shown at 6) to which operating rods from the four bolt straps are coupled by appropriate pin and slot connections, so that as the disc is rotated in the selected sense by operation of an external handwheel (not shown) the boltwork is thrown or withdrawn. The bolt straps 7 and 8 at the two side edges of the door carry respective locking bars 9 and 10 which translate horizontally as the boltwork is thrown, from the positions indicated in FIG. 1 to the positions indicated in FIG. 2. The bolt straps at the top and bottom edges of the door (not shown) carry respective locking bars 11 and 12 which translate vertically as the boltwork is thrown, again from the FIG. 1 positions to the FIG. 2 positions.

Each lock 2–5 has a bolt 13–16 which is coupled through a control member (to be more fully described hereinafter) to a respective locking arm 17–20, the arms being pivoted to the plate 1 at 21–24 respectively. FIG. 1 shows the mechanism in the condition when all of the locks are withdrawn and the main boltwork is withdrawn. In this condition the locking arms 17–20 are all pivoted to lie clear of the paths of movement of the bars 9–12. FIG. 2 shows the condition in which the boltwork is thrown and the locks are thrown. In this condition, referring first to lock 2, extension of the lock bolt 13 has pivoted the arm 17 to place its face 17A behind the face 9A of the horizontal locking bar 9, and to place its face 17B behind the face 11A of the vertical locking bar 11, thereby to block withdrawal of the bars 9 and 11 and the associated bolt straps from their thrown condition. Similarly, operation of the lock 3 is effective to pivot the arm 18 to place its face 18A behind the face 10A of the horizontal locking bar 10; operation of the lock 4 is effective to pivot the arm 19 to place its face 19A behind the face 9B of the horizontal locking bar 9 and to place its face 19B behind the face 12A of the vertical locking bar 12; and operation of the lock 5 is effective to pivot the arm 20 to place its face 20A behind the face 10B of the horizontal locking bar 10.

The manner in which the lock bolts 13–16 are interconnected with their locking arms 17–20 will now be described with reference to FIGS. 3 to 7, which show the arrangement for lock 2; the arrangement for the remaining locks 3–5 is, however identical.

Referring to FIGS. 3 to 6, the lock bolt 13 is shown to be connected to the arm 17 by means of a control member 25 comprising a part 26 which will be referred to as a cam, and with a pair of off-set pegs 27 and 28 extending from the opposite flanks of the cam to define a crank. The longer peg 27 is borne rotatably in the lock bolt 13 and the shorter peg 28 is received in a drive slot 29 in the arm 17. FIGS. 3 to 6 show the parts in their normal (non-negated) operative position, in which they are retained by the engagement between a spring-loaded plunger 30 in the bolt 13 and a corresponding recess 31 in the cam 26. In this position the control member provides an ordinary pinned connection between the bolt 13 and arm 17, to transmit the translational movement of the bolt to pivotal movement of the arm as the bolt is thrown between its unlocking position shown in FIG. 3 and its locking position shown in FIG. 6, and vice versa.

Let it now be assumed that the lock 2 is to be negated for a period. To achieve this the door must first be opened, which requires that the lock in question and all of the other locks are withdrawn, and the main boltwork is withdrawn. Having opened the door the main boltwork is re-thrown, as is the lock 2—ie to its position shown in FIG. 6. A hinged access panel (not shown) on the internal face of the door and which normally covers the locking mechanism is opened, to expose the mechanism. The control member 25 has an operating lever 32 fixed to the peg 27, and this lever is now turned anticlockwise (as viewed in the Figures) from the FIG. 6 position to that shown in FIG. 7, rotating the control member until a shoulder 33 on the cam 26 abuts a stop pin 34 on the bolt 13, and the plunger 30 engages with a second recess 35 (FIG. 5) in the cam. Moving the control member in this manner has two effects. First, the peg 28 is orbited to a new position which corresponds to the position which it adopts in normal (non-negated) operation when the lock bolt 13 is withdrawn (ie the same position as in FIG. 3); in so doing the peg 28 runs in the slot 29 to pivot the arm 17 back out of the path of the locking bars 9 and 11, again to the position which the arm adopts in normal operation when the lock bolt is withdrawn. In this condition, then, the lock 2 no longer has the ability to block withdrawal of the main boltwork, this function remaining under the control of the three other locks 3–5 which are unaffected by the negation of lock 2. Secondly, the lobe of the cam 26 is rotated to lie between the peg 27 and the edge 36 of the lock case thereby blocking any subsequent attempt to withdraw the lock bolt 13 (even by the holder of the correct key or combination). When eventually the lock is to be returned to normal operation, the door is opened and access gained to the mechanism and, with the main boltwork thrown, the lever 32 is turned back in the clockwise direction (as viewed in the Figures), until a shoulder 37 on the cam 26 abuts the stop pin 34 and the plunger 30 re-engages the recess 31—ie back to the FIG. 6 position. As will be appreciated, this pivots the locking arm 17 to its locking position and removes the cam lobe from proximity to the lock case edge 36, so enabling subsequent withdrawal of the bolt 13 by the holder of the correct key or combination for the lock, when required.

As previously indicated, each one of the locks 2–5 has an identical mechanism interconnecting its respective bolt and locking arm, and each one can be selectively negated, independently of the operation of the others, in the same way as described above for lock 2.

It will be seen from the foregoing that no lock can be negated without first opening the door, re-throwing the main boltwork, and re-throwing the respective lock bolt. If an attempt is made to negate a lock while the bolt of the lock remains withdrawn, it will be prevented by the abutment of the respective cam lobe against the lockcase, preventing rotation of the control member 25. If the door should be left open with the main boltwork thrown and locked and, while in this condition, an unauthorized person should gain access to the locking mechanism and manipulate one or more of the levers 32 to negate the corresponding lock(s), it would be immediately apparent to the authorized staff that such manipulation had taken place when they subsequently came to close the door, because the procedure to close the door from this condition first involves withdrawing the lock bolts and the bolt of the "negated" lock could not be withdrawn. It follows, therefore, that the design of the locking mechanism is such as inherently to guard against a lock being left in a negated condition without the active cooperation of a holder of the correct key or combination for the lock.

The illustrated mechanism is also of advantage in providing a means of escape from a vault in the event that persons should become accidentally or intentionally locked inside the vault. That is to say a person inside the vault and gaining access to the locking mechanism can turn all of the locks to their negated positions, thereby removing all imposed constraint against the withdrawal of the main boltwork, and the boltwork can be withdrawn to allow opening of the door by means of an additional handwheel attached to a spindle 38 provided for the purpose of the inside face of the door.

I claim:

1. A door for a security enclosure having a locking mechanism comprising a main boltwork and a plurality of independently-operable locks for resisting withdrawal of the boltwork when in its thrown condition, wherein at least one of said locks can be selectively negated independently of the other locks; the or each such negatable lock having a bolt coupled to a movable locking member such that throwing the lock bolt moves the respective locking member into a locking position to resist withdrawal of the main boltwork; and further comprising control means in respect of the or each such negatable lock which are selectively operable, only while the respective lock bolt is thrown, to withdraw the respective locking member from its said locking position and to resist subsequent withdrawal of the respective lock bolt.

2. A door according to claim 1 wherein the bolt of each such negatable lock is coupled to its respective locking member through a respective control member movable relative to both the bolt and the locking member; the control member having a non-negating position in which throwing the lock bolt moves the locking member into its locking position by virtue of the coupling provided by the control member, and a negating position into which the control member can be moved, only while the lock bolt is thrown, to withdraw the locking member from its locking position by virtue of such movement.

3. A door according to claim 2 wherein said control member is mounted rotatably to the lock bolt and includes a peg offset from the axis of rotation and engaging in a drive slot in the locking member.

4. A door according to claim 3 wherein said control member further comprises an abutment portion which, when the lock bolt is thrown and the control member is moved into its negating position, is placed in a position to abut a fixed obstruction thereby to resist subsequent withdrawal of the lock bolt.

5. A door according to claim 4 wherein said abutment portion is in the form of a lobe which is offset from the axis of rotation of the control member to the same side as said peg.

6. A door according to claim 2 wherein movement of said control member from its non-negating to its negating position when the lock bolt is withdrawn is prevented by abutment of a portion of the control member with a fixed obstruction.

7. A door according to claim 4 wherein said fixed obstruction is a part of the case of the respective said lock which includes the respective said lock bolt.

8. A door according to claim 6 wherein said fixed obstruction is a part of the case of the respective said lock which includes the respective said lock bolt.

9. A door according to claim 1 wherein physical access to said control means is available only from the internal face of the door.

10. A door according to claim 1 wherein each one of the plurality of locks can be selectively negated by operation of control means accessible from the internal face of the door; and further comprising means accessible from the internal face of the door for withdrawing the main boltwork when the locks have been negated.

11. A door according to claim 1 wherein there are four locks and the main boltwork comprises bolts which are thrown from the top, bottom and both side edges of the door; a first lock is coupled to a locking member having abutment surfaces to block withdrawal of both the top and one side edge bolts; a second lock is coupled to a locking member having an abutment surface to block withdrawal of the other side edge bolts; a third lock is coupled to a locking member having abutment surfaces to block withdrawal of both the bottom and said one side edge bolts; and the fourth lock is coupled to a locking member having an abutment surface to block withdrawal of said other side edge bolts.

12. A door according to claim 11 wherein said four locks are disposed in a rectangular array with said first and second locks above said third and fourth locks.

* * * * *

UNITED STATES PATENT AND TRADEMARK OFFICE

CERTIFICATE OF CORRECTION

PATENT NO. : 4,407,204

DATED : October 4, 1983

INVENTOR(S) : Geoffrey M. Ward

It is certified that error appears in the above-identified patent and that said Letters Patent is hereby corrected as shown below:

On the title page Insert:

__[30] Foreign Application Priority Data

December 12, 1980 [GB] United-Kingdom 8039984 --.

Signed and Sealed this

Seventeenth Day of July 1984

[SEAL]

*Attest:*

GERALD J. MOSSINGHOFF

*Attesting Officer*

*Commissioner of Patents and Trademarks*